US012612755B2

(12) United States Patent
Qiu et al.

(10) Patent No.: US 12,612,755 B2
(45) Date of Patent: Apr. 28, 2026

(54) PRE-DISINTEGRATED SOFT ROCK EMBANKMENT STRUCTURE BASED ON SPATIAL FUNCTION ZONES AND DESIGN METHOD THEREOF

(71) Applicant: CHANGSHA UNIVERSITY OF SCIENCE & TECHNOLOGY, Hunan (CN)

(72) Inventors: Xiang Qiu, Changsha (CN); Jiyuan Zhu, Changsha (CN)

(73) Assignee: CHANGSHA UNIVERSITY OF SCIENCE & TECHNOLOGY, Changsha City (CN)

( * ) Notice: Subject to any disclaimer, the term of this patent is extended or adjusted under 35 U.S.C. 154(b) by 157 days.

(21) Appl. No.: 18/641,807

(22) Filed: Apr. 22, 2024

(65) Prior Publication Data

US 2025/0101701 A1 Mar. 27, 2025

(30) Foreign Application Priority Data

Sep. 21, 2023 (CN) ..... 202311230208.8

(51) Int. Cl.
*E02D 17/20* (2006.01)
*E02D 17/18* (2006.01)

(52) U.S. Cl.
CPC ..... *E02D 17/20* (2013.01); *E02D 17/18* (2013.01)

(58) Field of Classification Search
CPC ..... E02D 17/20; E02D 17/18; E02D 3/08; E02D 3/12
See application file for complete search history.

(56) References Cited

U.S. PATENT DOCUMENTS 6,244,102 B1 * 6/2001 Novak ..... E01C 19/288 73/78
8,452,550 B2 * 5/2013 Jeong ..... E02D 1/022 702/42
2004/0109730 A1 * 6/2004 Moss ..... E01B 37/00 405/258.1
2013/0090902 A1 * 4/2013 Yao ..... G06F 30/23 703/2
2022/0398807 A1 * 12/2022 Sun ..... G06F 30/28

FOREIGN PATENT DOCUMENTS

CN 115288162 A * 11/2022 ..... G06F 30/20

* cited by examiner

*Primary Examiner* — Benjamin F Fiorello
(74) *Attorney, Agent, or Firm* — BROOKS KUSHMAN P.C.

(57) ABSTRACT

A pre-disintegrated soft rock embankment structure based on spatial function zones and a design method thereof are provided. The embankment structure includes an embankment shear control zone, an embankment settlement control zone, and an embankment shear-settlement control zone. The embankment shear control zone is a zone in which a shear failure ratio is greater than a predetermined value. The embankment settlement control zone is a filled zone right below a top surface of an embankment. The embankment shear-settlement control zone is an intersection of the embankment shear control zone and the embankment settlement control zone. The provided structure and method improve the shear strength, stability, and durability, reduce footprint, shorten a settlement duration after construction, and solve engineering problems such as low slope ratio and large deformation of an embankment due to a long period of subsequent disintegration in the prior art.

9 Claims, 7 Drawing Sheets

Distribution of shear failure ratios of embankment

Embankment shear control zone

Embankment settlement control zone

Embankment shear-settlement control zone

Distribution of shear failure ratios of embankment

PRE-DISINTEGRATED SOFT ROCK EMBANKMENT STRUCTURE BASED ON SPATIAL FUNCTION ZONES AND DESIGN METHOD THEREOF

CROSS-REFERENCE TO RELATED APPLICATIONS

This application claims foreign priority benefits under 35 U.S.C. § 119(a)-(d) to Chinese Patent Application No. 202311230208.8 filed on Sep. 21, 2023, the disclosure of which is hereby incorporated herein by reference in its entirety.

TECHNICAL FIELD

The present disclosure belongs to the technical field of side slope treatment and relates to a pre-disintegrated soft rock embankment structure based on spatial function zones and a design method thereof.

BACKGROUND

Soft rock is mainly formed by some clay minerals through long-term consolidation, and because of a weak bonding force between mineral grains, the soft rock generally has the characteristics of strong hydro-physical properties, easy weathering and disintegration, low strength, and large deformation. During the construction of a project such as a highway and a railway, the excavated geological mass of soft rock in some areas is discarded as a bad filling, and in this case, both of the discarded geological mass of soft rock and a replacing good-quality filling will occupy a large amount of land. In another area, the excavated geological mass of soft rock will be rapidly disintegrated first and then used for embankment filling. However, the geological mass of soft rock that has been disintegrated in advance may still undergo slow disintegration continuously, and the pre-disintegrated soft rock is angular and porous, thus causing a great settlement deformation and instability failure of the embankments.

At present, for some highways and railways, due to the limitations of route selection, they may often pass through areas densely covered with soft rock. If encountering disintegrative soft rock in the process of building a road abroad, the following two treatment manners are generally adopted: discarding or prolonging a construction period (the purpose of prolonging the construction period is to disintegrate the soft rock completely). However, such treatment manners cannot be copied in China due to constraints of conditions such as land resources, an economic situation, and a construction cycle. In China, when bad geological rock-soil mass is utilized to fill an embankment, the following techniques are mainly adopted for treatment: (1) a traditional reinforcement material such as a geosynthetic material and a geogrid, and a novel reinforcement material such as a Gabion reinforcement material, are used to reinforce and strengthen the mixture of soft rock-soil. (2) The various properties of soil are comprehensively changed by using techniques such as overall modification and strengthening, thus further improving the performance of the embankment. (3) The pre-disintegrated soft rock embankment is treatment by grouting strengthening and lifting. Although the above techniques can effectively control and ameliorate problems caused by embankment filling with bad geological rock-soil mass, there are many defects and shortcomings:

First, layered geogrids may increase a coefficient of embankment stability, but has a poor effect in controlling embankment settlement deformation.

Second, the overall modification and strengthening may have good effects in various aspects, but it cannot produce plenty of economic benefits due to a high cost, and thus is less used in engineering construction.

Third, the way of grouting strengthening and lifting not only incurs high engineering construction cost, but also uneven splitting grouting for lifting may easily result in the "vehicle bumping" phenomenon on a pavement, which may seriously affect the driving comfort and the traffic safety.

Fourth, when the pre-disintegrated soft rock is used as an embankment filling material, there is no clear solution proposed in an existing embankment structure design.

The prior art (publication number: CN114912163A) relates to calculation of subgrade settlement, but is unsuitable for a pre-disintegrated soft rock embankment structure design.

In view of this, to eliminate harm caused by disintegration of soft rock when used as a filling material, improve the pavement usage performance, reduce the pavement maintenance cost, reduce the influence of construction on traffic, and the like, there is an urgent need for designing a method of a pre-disintegrated soft rock embankment structure, which is especially important in the subgrade engineering field.

SUMMARY

To solve the above-mentioned problems, the present disclosure provides a pre-disintegrated soft rock embankment structure based on spatial function zones, thereby improving the shear strength, stability, and durability, reducing an occupied area, shortening a settlement duration after construction, and solving engineering problems such as low slope ratio and large deformation of an embankment due to a long period of subsequent disintegration in the prior art.

Another objective of the present disclosure is to provide a design method of a pre-disintegrated soft rock embankment structure based on spatial functional zones.

The present disclosure adopts the following technical solution: a pre-disintegrated soft rock embankment structure based on spatial function zones includes an embankment shear control zone, an embankment settlement control zone, and an embankment shear-settlement control zone.

The embankment shear control zone is a zone in which a shear failure ratio is greater than a predetermined value.

The embankment settlement control zone is a filled zone right below a top surface of an embankment.

The embankment shear-settlement control zone is an intersection of the embankment shear control zone and the embankment settlement control zone.

In another aspect, a design method of a pre-disintegrated soft rock embankment structure based on spatial function zones is provided according the present disclosure, which includes the following steps:

S1, performing field sampling at a pre-disintegrated soft rock embankment and preparing a sample by a stratified sample compression method;

S2, conducting a static triaxial test on the sample in step S1 under test conditions of different confining pressures to obtain a cohesive force c and an internal friction angle of pre-disintegrated soft rock-soil mass, and obtaining a strength envelope formula for pre-disintegrated soft rock by processing static triaxial test data;

S3, conducting a dynamic triaxial test on the sample in step S1 with different stress ratios, compaction degrees, and confining pressures to obtain a permanent axial deformation and a dynamic rebound modulus of embankment soil mass under action of a dynamic load, and establishing a prediction model for a dynamic rebound modulus of embankment soil mass and a prediction model for a permanent strain of a subgrade under the action of the dynamic stress;

S4, establishing a two-dimensional finite element numerical model of the pre-disintegrated soft rock embankment through finite element software, with consideration of the action of a dynamic stress and with an X-axis representing a longitudinal length of the subgrade and a Y-axis representing a height of the subgrade, meshing the two-dimensional finite element numerical model to export coordinates of each node in the two-dimensional finite element numerical model and a vertical stress $\sigma_{1qj}$, a lateral stress $\sigma_{3qj}$, and a dynamic stress $\sigma'_{qj}$ corresponding to each node;

S5, conducting a static triaxial creep test on the sample prepared in step S1 with different stress ratios and compaction degrees to obtain a permanent axial deformation of the embankment soil mass under action of a static stress, and establishing a prediction model for a permanent strain of a subgrade under the action of the static stress;

S6, establishing a two-dimensional finite element numerical model of the pre-disintegrated soft rock embankment by using the finite element software without consideration of the action of the dynamic stress, obtaining distribution rules of depths and shear failure ratios of a subgrade workspace, and dividing an embankment structure into the embankment shear control zone, the embankment settlement control zone, and the embankment shear-settlement control zone; and S7, based on divided spatial function zones, obtaining parameter design values of different zones by inversion, and carrying out a modified mixing ratio for pre-disintegrated soft rock.

The present disclosure has following beneficial effects:

1. In the present disclosure, according to a shear failure ratio and settlement deformation of a pre-disintegrated soft rock embankment, the embankment includes a shear control zone, a settlement control zone, and a shear-settlement control zone, and the parameter design values of different zones are obtained by inversion based on the spatial function zones. The problems of the design method of a pre-disintegrated soft rock embankment structure based on spatial function zones are solved, and limitations of usually adopting treatment techniques such as sloping and supporting and retaining structure formation and neglecting the shear failure state of embankment filling mass itself in existing domestic and foreign research methods is broken. It can serve as an important reference for design methods and construction techniques of a pre-disintegrated soft rock embankment structure.
2. In the present disclosure, a spatial function zoning method is used to design a pre-disintegrated soft rock embankment structure, whereby not only can the problems of long settlement duration and large deformation of the pre-disintegrated soft rock embankment after construction be solved, but also significant advantages, such as small footprint, are taken into account.
3. In the present disclosure, prediction models for a dynamic rebound modulus, a dynamic creep deformation, a static creep deformation, and the like of the pre-disintegrated soft rock filling mass are established, in which the influences of vehicle loads on the strength of soil mass and the self-weight of soil mass on differential settlement of the subgrade are taken into full consideration, and which are closer to actual situations and has higher accuracy.
4. In embodiments of the present disclosure, an optimal mixing ratio of the grouting filling material is determined by conducting a test with respect to the basic physical and mechanical properties of a modified grouting material, whereby the compaction inside the pre-disintegrated soft rock can be improved positively, and the settlement deformation of the subgrade can be effectively reduced, and the subgrade has good durability after grouting filling with the optimal mixing ratio of the grouting filling material.

BRIEF DESCRIPTION OF THE DRAWINGS

To describe the technical solutions in the embodiments of the present disclosure or in the prior art more clearly, the following briefly describes the accompanying drawings required for describing the embodiments or the prior art. Apparently, the accompanying drawings in the following description show merely some embodiments of the present disclosure, and those skilled in the art may still derive other drawings from these accompanying drawings without creative efforts.

Figure 1:
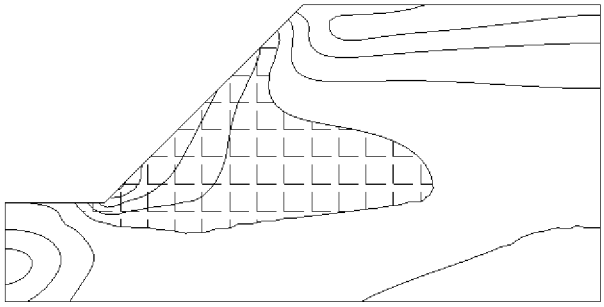
FIG. 1 is a schematic diagram of an embankment shear control zone according to an embodiment of the present disclosure.

List of Reference Numerals: 1—grouting pipe, 2—pavement, 3—grouting radius, and 4—foundation.

DETAILED DESCRIPTION

The technical solutions in the examples of the present disclosure are clearly and completely described below with reference to the examples of the present disclosure. Apparently, the described examples are merely a part rather than all of the examples of the present disclosure. All other embodiments derived from the embodiments in the present disclosure by a person of ordinary skill in the art without creative efforts shall fall within the protection scope of the present disclosure.

Example 1

Figure 2:
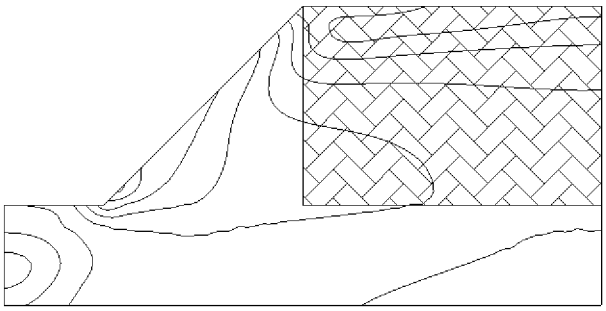
FIG. 2 is a schematic diagram of an embankment settlement control zone according to an embodiment of the present disclosure.
Figure 3:
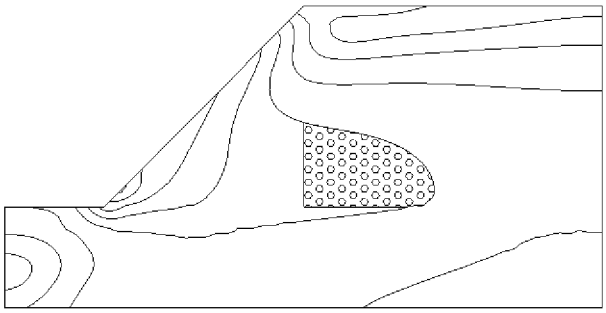
FIG. 3 is a schematic diagram of an embankment shear-settlement control zone according to an embodiment of the present disclosure.

A pre-disintegrated soft rock embankment structure based on spatial function zones, according to different functions of different zones in embankment stability, includes an embankment shear control zone (as shown in FIG. 1), an embankment settlement control zone (as shown in FIG. 2), and an embankment shear-settlement control zone (as shown in FIG. 3).

The shear control zone, the settlement control zone, and the shear-settlement control zone are defined as follows: a zone in which a shear failure ratio is greater than a predetermined value is defined as the shear control zone; a filled zone right below a top surface of an embankment is defined as the settlement control zone; and an intersection of the shear control zone and the settlement control zone is defined as the shear-settlement control zone.

In the example of the present disclosure, according to the shear failure ratio and settlement deformation of the pre-disintegrated soft rock embankment, the embankment is divided into the shear control zone, the settlement control zone, and the shear-settlement control zone, and explicit zoning methods are given. Compared with an existing technique of zoning simply by numerical simulation software, the solution according to embodiments of the present disclosure is closer to an actual situation and higher in accuracy. Not only specification requirements on a slope shear failure ratio and subgrade settlement can be met, but also the problems of long settlement duration and large deformation of the pre-disintegrated soft rock embankment after construction can be solved, and the significant advantage of small, occupied area is taken into account.

Example 2

A design method of a pre-disintegrated soft rock embankment structure based on spatial function zones includes the following steps S1 to S7.

In step S1, field sampling is performed at a pre-disintegrated soft rock embankment and a sample is prepared by a stratified sample compression method.

In step S2, a static triaxial test is conducted on the sample prepared in step S1 under test conditions of different confining pressures to obtain a cohesive force c and an internal friction angle φ of soil mass.

The static triaxial test is a consolidated-undrained static triaxial test in which a compaction degree of the sample is 96%, the confining pressures are set to 10 kPa, 20 kPa, 30 kPa, 40 kPa, and 50 kPa, and a water content of the soil mass is a natural moisture content.

The following strength envelope formula for pre-disintegrated soft rock with the compaction degrees of 96% is obtained by processing static triaxial test data: $\tau=0.379\sigma+13.02$ i.e., internal friction angle $\varphi=20.7°$, and cohesive force c=13.02 kPa.

In step S3, a dynamic triaxial test is conducted on the sample prepared in step S1 with different stress ratios, compaction degrees, and confining pressures to obtain a permanent axial deformation and a dynamic rebound modulus of embankment soil mass under the action of a dynamic load.

The stress ratios in the dynamic triaxial test are set to 1.2:1, 1.4:1, 1.6:1, 1.8:1, and 2.0:1; the compaction degrees are set to 90%, 93%, and 96%; the confining pressures are set to 10 kPa, 20 kPa, 30 kPa, 40 kPa, and 50 kPa; the water content of the soil mass is the natural moisture content; and times of the dynamic load application is 10000.

By analyzing test results, a change rule of the dynamic rebound modulus of the embankment soil mass under conditions of different stress ratios, compaction degrees, and confining pressures is obtained, and a prediction model for a dynamic rebound modulus of embankment soil mass is established, as shown in Equation (1):

$$E_1 = E_0 \cdot \left(2.51 \frac{\sigma_{11}}{\sigma_{31}}^{-1.72}\right) \cdot \left(-1.16\, e^{-\frac{\sigma_{31}}{0.15\,Pa}} + 1.11\right) \cdot \left(12.12\, K^{61.15}\right) \tag{1}$$

where $E_0$ represents an initial dynamic rebound modulus of a common group (with the stress ratio of 1.6:1, the confining pressure of 30 kPa, and the compaction degree of 96%), $E_0$=187.58 MPa; $E_1$ represents the dynamic rebound modulus of the embankment soil mass; e represents a constant;

$$\frac{\sigma_{11}}{\sigma_{31}}$$

represents a stress ratio; $\sigma_{31}$ represents a confining pressure; $P_a$ represents a standard atmospheric pressure, $P_a$=101.4 kPa; K represents a compaction degree of the embankment soil mass; and $\sigma_{11}$ represents an axial pressure.

According to relationship of influencing factors with a strain in a dynamic triaxial creep test, multiple non-linear regression analysis is performed on the test data, and a prediction model for a permanent strain of a subgrade under the action of a dynamic stress is established, as shown in Equation (2):

$$\varepsilon_2 = \varepsilon_{02} \cdot \left(0.17 \frac{\sigma_{11}}{\sigma_{31}}^{2.75}\right) \cdot \left(1.15 - 0.38\, e^{-\frac{\sigma_{31}}{0.37\,Pa}}\right) \cdot \left(0.42\, K^{-34.4}\right) \tag{2}$$

where $\varepsilon_{02}$ represents an initial plastic strain of the common group (with the stress ratio of 1.6:1, the confining pressure of 30 kPa, and the compaction degree of 96%), $\varepsilon_{02}=1734.61\times10^{-6}$; and $\varepsilon_2$ represents the permanent strain of the subgrade.

Figure 4:
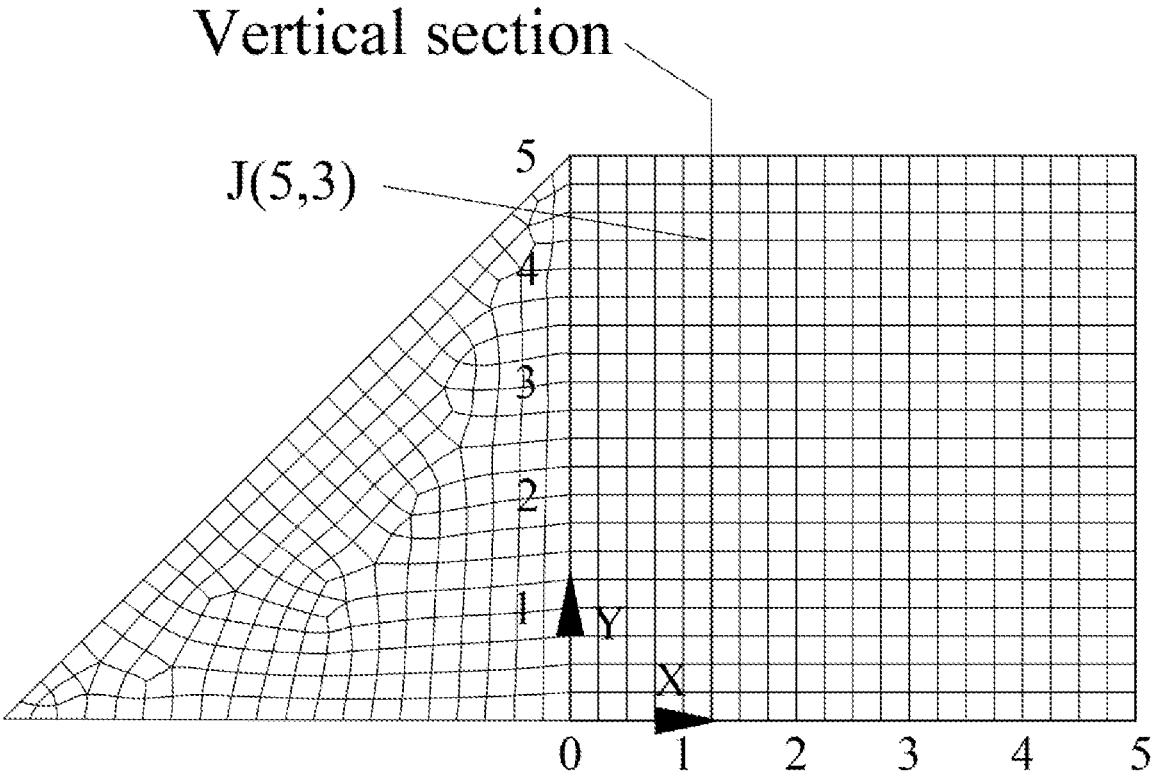
FIG. 4 is a diagram of meshing of a two-dimensional model of an embankment in an embodiment of the present disclosure.

In step S4, a two-dimensional model of the pre-disintegrated soft rock embankment is established through ABAQUS finite element software with a height set to 5 m and with consideration of the action of a dynamic stress, as shown in FIG. 4, in which an X-axis represents a longitudinal length of a subgrade (i.e., a width of the subgrade) and a Y-axis represents a height of the subgrade. The two-dimensional model is meshed, and the shape of a grid is a square with an side length of 0.25 m. Taking a vertical section for example, a height between two adjacent upper and lower nodes is $h_f$ (0.25 m); nodes are sequentially numbered from the top down; the first node in the vertical section is numbered as J (q,0), and the following nodes are sequentially numbered as J (q,1), J (q,2), . . . , J (q,j), q representing the number of columns of nodes and j representing the number of rows of nodes (q, j=0, 1, 2 . . . ); and coordinates of each node in the two-dimensional model and a vertical stress $\sigma_{1qj}$, a lateral stress $\sigma_{3qj}$, and a dynamic stress $\sigma'_{qj}$ corresponding to each node are derived.

A stress $\sigma_{qj}$ of each node under the combined action of a dynamic stress and a self-weight stress is calculated by Equation (3):

$$\sigma_{qj} = \sigma_{1qj} + \sigma'_{qj} \tag{3}$$

where $\sigma'_{qj}$ represents the dynamic stress of each node derived from the two-dimensional model; and $\sigma_{1qj}$ represents the vertical stress corresponding to each node derived from the two-dimensional model.

A strain value $\varepsilon_{1qj}$ of each node under the combined action of a dynamic stress and a self-weight stress is calculated by Equation (4):

$$\varepsilon_{1qj} = \sigma_{qj}/E_{1qj} \tag{4}$$

where the dynamic rebound modulus $E_{1qj}$ is calculated by substituting the vertical stress $\sigma_{1qj}$ and the lateral stress $\sigma_{3qj}$ of a node in a subgrade workspace (a zone in which a ratio of a dynamic stress to a self-weight stress is less than 0.1) into Equation (1), where $\sigma_{1qj}$ corresponds to $\sigma_{11}$ in Equation (1), and $\sigma_{3qj}$ corresponds to $\sigma_{31}$ in Equation (1).

A total rebound deformation value $S_{1x}$ on a vertical section of the subgrade workspace under the action of a dynamic stress is calculated by Equation (5):

$$S_{1x} = \sum S_{1f} = \sum_{f=1}^{n} \overline{\varepsilon_{1qj}} h_f \tag{5}$$

where $S_{1f}$ represents a deformation between two adjacent nodes in the vertical section under the action of the dynamic stress; $\overline{\varepsilon_{1qj}}$ represents an average strain between two adjacent nodes in the vertical section under the action of the dynamic stress; and $h_f$ represents a height between two adjacent nodes of the vertical section within the subgrade workspace, namely representing a length between an upper node and a lower node of the fth node segment, f=1, 2, . . . n.

A total settlement value $S_{2x}$ on a vertical section of the subgrade workspace under the action of a dynamic stress is calculated by Equation (6):

$$S_{2x} = \sum S_{2f} = \sum_{f=1}^{n} \overline{\varepsilon_{2qj}} h_f \tag{6}$$

where $S_{2f}$ represents a dynamic creep deformation between two adjacent nodes in the vertical section under the action of the dynamic stress; and $\overline{\varepsilon_{2qj}}$ represents an average strain between two adjacent nodes in the vertical section under the action of the dynamic stress.

In step S5, a static triaxial creep test is conducted on the sample prepared in step S1 under test conditions such as different stress ratios and compaction degrees to obtain a permanent axial deformation of the embankment soil mass under the action of a static stress.

The stress ratios are set to 1.2:1, 1.4:1, 1.6:1, 1.8:1, and 2.0:1; the compaction degrees of the embankment soil mass are set to 90%, 93%, and 96%; the confining pressures are set to 10 kPa, 20 kPa, 30 kPa, 40 kPa, and 50 kPa; and the water content of the soil mass is the natural moisture content.

By processing test data, a change rule of the permanent axial deformation of the embankment soil mass under conditions of different stress ratios, compaction degrees, and confining pressures in the static triaxial creep test is obtained, and multiple non-linear regression analysis is performed on the test data, and a prediction model for a permanent strain of a subgrade under the action of a static stress is established, as shown in Equation (7):

$$\varepsilon_3 = \varepsilon_{03} \cdot \left(0.18 \frac{\sigma_{11}}{\sigma_{31}}^{2.54}\right) \cdot \left(0.13 e^{\frac{\sigma_{31}}{0.24 P_a}} + 0.59\right) \cdot \left(0.54 K^{-34.44}\right) \tag{7}$$

where $\varepsilon_{03}$ represents an initial plastic strain of the soil mass of the common group (with the stress ratio of 1.6:1, the confining pressure of 30 kPa, and the compaction degree of 96%), $\varepsilon_{03}=177.26\times10^{-6}$; and $\varepsilon_3$ represents the permanent strain of the subgrade under the action of a self-weight stress.

A total settlement value $S_{3x}$ on a vertical section of a subgrade non-workspace under the action of a self-weight stress is calculated by Equation (8):

$$S_{3x} = \sum S_{3f} = \sum_{f=1}^{n} \overline{\varepsilon_{3qj}} h_f \tag{8}$$

where $S_{3f}$ represents a static creep deformation between two adjacent nodes in the vertical section under the action of the self-weight stress; and $\overline{\varepsilon_{3qj}}$ represents an average strain between two adjacent nodes in the vertical section under the action of the self-weight stress.

Based on superimposed settlement of unit nodes, a total settlement deformation $S_x$ of any vertical section in the longitudinal length direction of the subgrade is calculated by Equation (9):

$$S_x = S_{1x} + S_{2x} + S_{3x} \tag{9}$$

Equations (3) to (5) are used for calculating the rebound deformation of the subgrade workspace under the action of the dynamic stress; Equation (6) is used for calculating the total settlement value of the subgrade workspace under the action of the dynamic stress; Equation (7) is used for calculating the total settlement value on the vertical section of the subgrade non-workspace under the action of the self-weight stress; and Equation (9) is used for calculating the total settlement deformation in the longitudinal length direction of the subgrade (including the subgrade workspace and the subgrade non-workspace). These strain prediction models and settlement calculation equations all have test basis and are close to actual situations.

The calculation of the total settlement deformation $S_x$ of the subgrade in S5 includes the rebound deformation and the settlement deformation of the subgrade workspace under the action of the dynamic stress and the settlement deformation of the subgrade non-workspace under the action of the self-weight stress.

Figure 5:
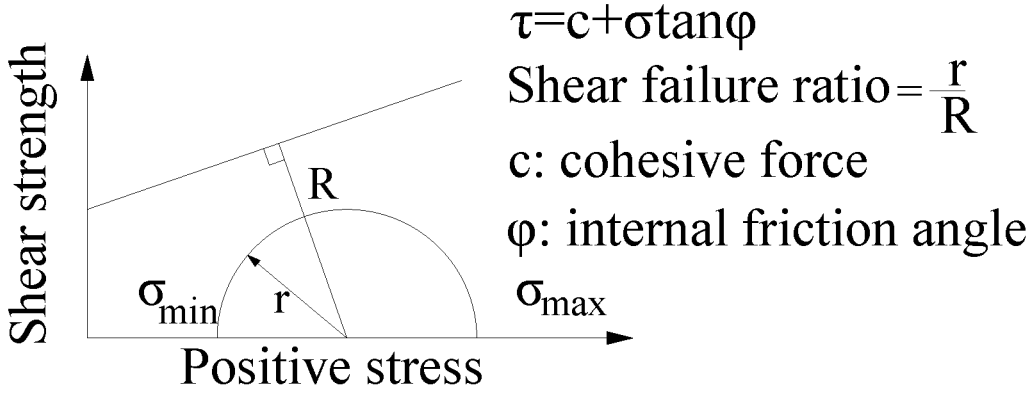
FIG. 5 is a schematic diagram of a shear failure ratio in an embodiment of the present disclosure.
Figure 6:
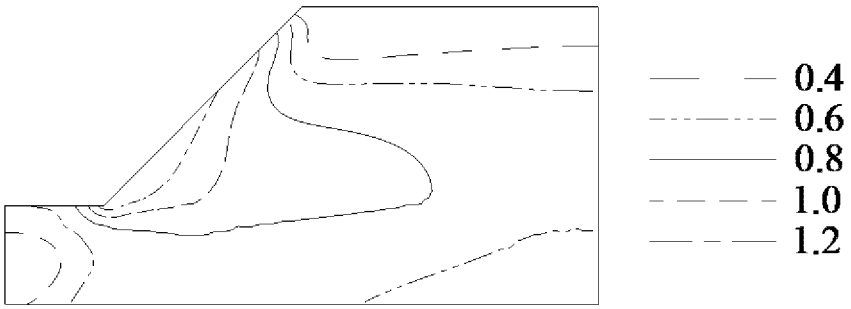
FIG. 6 is a distribution diagram of shear failure ratios of an embankment according to an embodiment of the present disclosure.

In step S6, a two-dimensional finite element numerical model of the pre-disintegrated soft rock embankment at different heights and slopes is established by using the ABAQUS finite element software with an embankment height set to 15 m and with no consideration of the action of a dynamic stress, and parameters such as a vertical self-weight stress, a lateral self-weight stress, and shear stress of the pre-disintegrated soft rock embankment at different positions are analyzed. The cohesive force c and the internal friction angle φ are obtained by step S2, and the shear strength envelope ($\tau=0.379\sigma+13.02$) of the pre-disintegrated soft rock with the compaction degree of 96% is plotted. A maximum normal stress and a minimum normal stress on the soil mass at a different position of the embankment are then obtained by numerical simulation. The shear failure ratio F of the embankment at each position is calculated by Equation (10), as shown in FIG. 5. Finally, a distribution rule of the shear failure ratios of the subgrade is obtained, as shown in FIG. 6.

$$F = \frac{r}{R} \tag{10}$$

where r represents a radius of a Mohr's' stress circle of the embankment soil mass plotted in a current stress state, and R represents a vertical distance of a center of the Mohr's' stress circle to a shear strength envelope.

According to the distribution rule of the shear failure ratios of the pre-disintegrated soft rock embankment under conditions such as different heights and slopes, the zone in which the shear failure ratio is greater than a fixed value (with reference to the "Specifications for Design of Highway Subgrades JTGD30-2019", the safety factor of embankment is not less than 1.2, which is 20% higher than the critical value 1.0, and a fixed value of the shear failure ratio is determined to be 20% lower than the critical value 1.0, i.e., the fixed value of the shear failure ratio is 0.8) is defined as the shear control zone, as shown in FIG. 1. The filled zone right below the top surface of the embankment is defined as the settlement control zone (with reference to the "Specifications for Design of Highway Subgrades (JTGD30-2015)", the highway grade is heavy duty, and the subgrade deformation design value is 20 mm), as shown in FIG. 2. The intersection of the shear control zone and the settlement control zone is defined as the shear-settlement control zone, as shown in FIG. 3.

In step S7, with consideration of a thickness of compaction in layers and an operation width of a compacting machine (taking ZN390B compacting machinery as an example, the operation width is 1.2 m and the thickness of compaction in layers is 0.3 m) in the filling process of the pre-disintegrated soft rock embankment, the embankment shear control zone is divided into a plurality of zones according to the width of 1.2 m and the height of 0.3 m, and with the shear failure ratio 0.8 as a target value, combined with shear failure ratio peaks of the different zones within the shear control zone, inversion is performed on the shear parameter design values of the different zones within the shear control zone. A modifying mixing ratio design is carried out for the pre-disintegrated soft rock, and the shear failure ratio F is caused to be less than the designed safe value 0.8 by increasing the cohesive force c and the internal friction angle φ thereof, thus ensuring the safety and stability of the embankment.

For the settlement control zone, with reference to the "Specifications for Design of Highway Subgrades (JTGD30-2015)", the highway grade is heavy duty, and the subgrade deformation design value is 20 mm. That is, an inversion parameter is subgrade settlement deformation value 20 mm, and with this as an indicator, a suitable compaction degree of filling mass, grouting pressure, and distance to a grouting pipe are selected to reduce the subgrade settlement deformation, thereby meeting requirements of the specification.

Inversion parameters of the shear-settlement control zone are shear failure ratio 0.8 and subgrade settlement deformation value 20 mm. Firstly, when the shear failure ratio is less than 0.8 and the subgrade settlement deformation value is less than 20 mm, it indicates that requirements of the specification are met. Secondly, various design parameters are regulated by the inversion parameters. For example, the shear failure ratio is used to obtain a suitable mixing amount of cement by Equation (13), and the subgrade settlement deformation value is used for selecting the filling mass compaction degree, the grouting pressure, and the distance to a grouting pipe.

A treatment method for the embankment shear control zone is as follows:

The pre-disintegrated soft rock obtained in step S1 is mixed with different proportions of cement, and specific proportions are 0%, 1%, 2%, 4%, and 8%, and samples are prepared by the stratified sample compression method. The static triaxial test is conducted on each prepared sample under test conditions of different confining pressures to obtain the cohesive force c and the internal friction angle φ of the modified soil mass.

The static triaxial test is the consolidated-undrained static triaxial test in which the compaction degree of the sample is 96% and the confining pressures are set to 10 kPa, 20 kPa, 30 kPa, 40 kPa, and 50 kPa.

Figure 7:
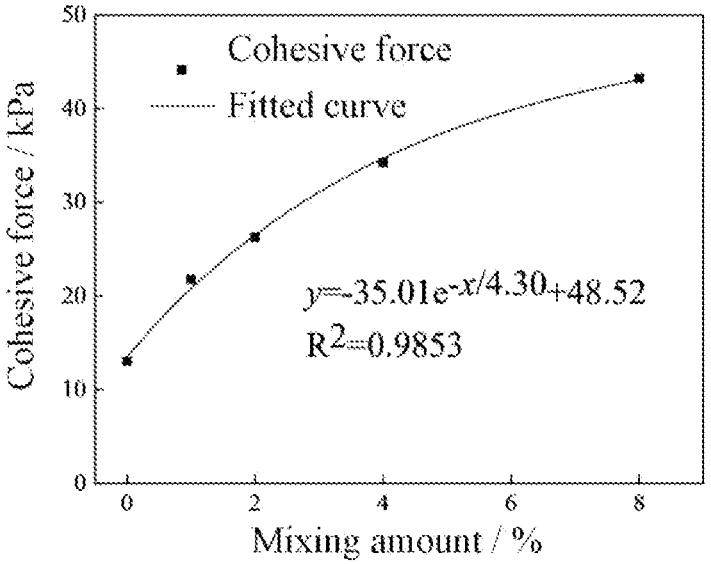
FIG. 7 is a diagram illustrating a fitted curve function of a cohesive force versus a mixing amount according to an embodiment of the present disclosure.
Figure 8:
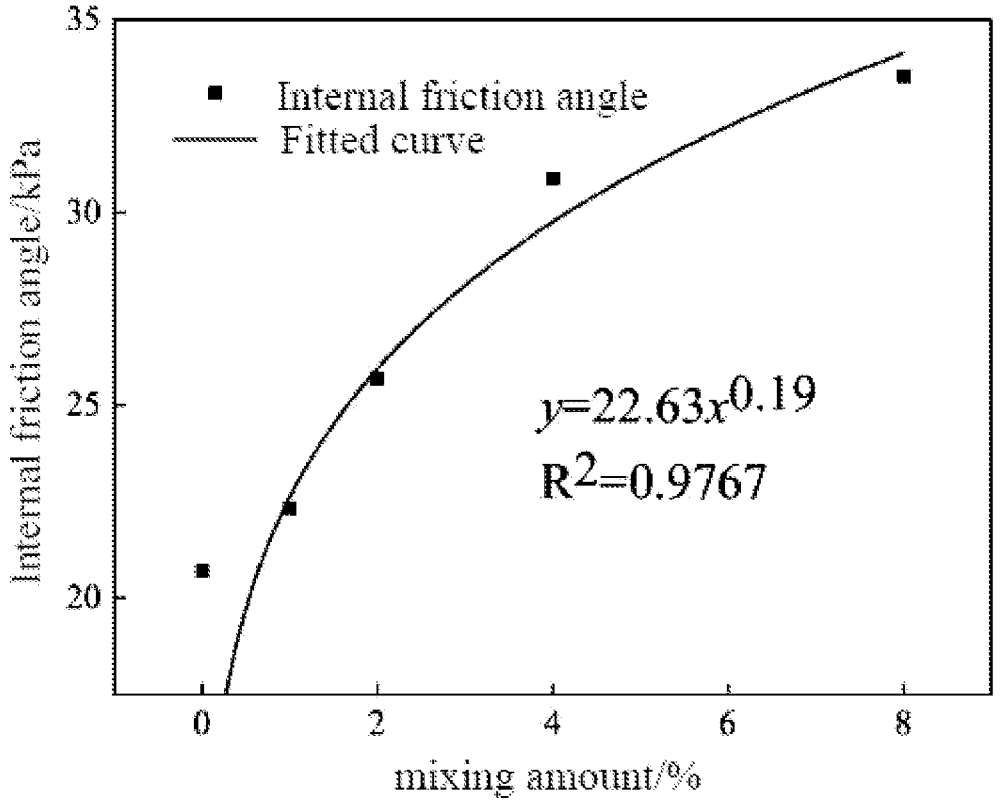
FIG. 8 is a diagram illustrating a fitted curve function of an internal friction angle versus a mixing amount according to an embodiment of the present disclosure.

By processing the test data, respective relationships of the cohesive force c and the internal friction angle φ of the modified soil mass with a mixing amount are obtained, and corresponding functions are fitted by data analysis software, as shown in FIG. 7 and FIG. 8.

The respective fitted curve functions of the cohesive force c and the internal friction angle φ of the modified soil mass with a mixing amount are as follows:

$$\grave{c} = g(x) = -35.01e^{-x/4.3} + 48.52 \tag{11}$$

$$\grave{\varphi} = f(x) = 22.63x^{0.19} \tag{12}$$

where c' represents the cohesive force after modification; φ' represents the internal friction angle after modification; and x represents the mixing amount, $x \in [1\%, 8\%]$.

The prediction model for a shear failure ratio under the influence of different mixing amounts is established according to the relationships of the cohesive force c and the internal friction angle with the shear failure ratio F in the modification test, as shown in Equation (13):

$$F = \frac{r}{R} = \frac{(\sigma_{max} - \sigma_{min})\left(\sqrt{\tan^2 f(x) + 1}\right)}{2(\tan f(x) \cdot L + g(x))} \tag{13}$$

where r represents the radius of the Mohr's stress circle of the embankment soil mass plotted in the current stress state, and R represents the vertical distance of the center of the Mohr's stress circle to the shear strength envelope, $$r = \frac{\sigma_{max} - \sigma_{min}}{2}, R = \frac{\tan\varphi \cdot L + c}{\sqrt{\tan^2\varphi + 1}}, L = \frac{\sigma_{max} + \sigma_{min}}{2},$$

$\sigma_{max}$ representing a maximum principal stress on the soil mass at the current position and $\sigma_{min}$ representing a minimum principal stress on the soil mass at the current position.

Equation (13) is the basis for inversion of the shear control zone, and the stress state of the soil mass at a position is determined. Therefore, the shear failure ratio of this position may be calculated. If the shear failure ratio of this position does not meet the requirement, the cohesive force and the internal friction angle of the soil mass may be increased by means of mixing cement for modification, thus meeting requirements of the specification. Inversion is performed via Equation (13) with the shear failure ratio of 0.8, to calculate an optimal mixing amount of cement x.

Figure 9:
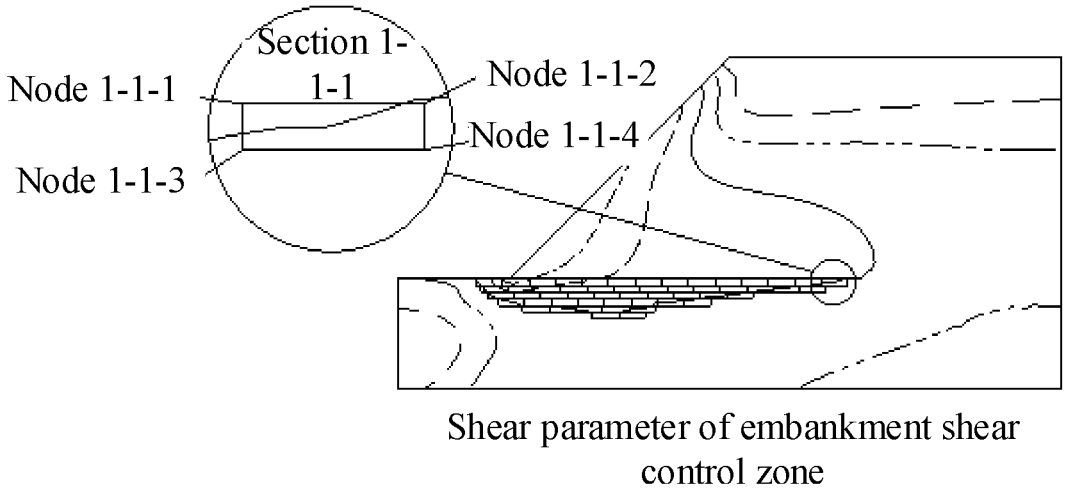
FIG. 9 is a schematic diagram of section 1-1 according to an embodiment of the present disclosure.

For the shear control zone, a diagram illustrating a shear parameter of the embankment shear control zone is shown in FIG. 9, and the shear failure ratio F of each node in section 1-1 is obtained by Kriging interpolation method as follows: the shear failure ratio F of node 1-1-1 is 0.794, the shear failure ratio F of node 1-1-2 is 0.798, the shear failure ratio F of node 1-1-3 is 0.802, and the shear failure ratio F of node 1-1-4 is 0.808, where the shear failure ratio F of the node 1-1-4 is the largest, and the shear strength of the soil mass at this position is obtained by inversion with the stress state of this node, thereby obtaining the optimal mixing amount for modification of the section 1-1.

The maximum principal stress $\sigma_{max}$ on the node 1-1-4 is equal to −31.76 MPa and the minimum principal stress $\sigma_{min}$ is equal to −91.15 MPa. By substituting data of the node 1-1-4 into Equation (13), the optimal mixing amount for modifying the soil mass with cement is obtained as 1% by inversion. After modification, the shear failure ratio F of this node is 0.64, which is less than the designed safe value 0.8 and meets the requirement.

The treatment method for the embankment settlement control zone is as follows:

Tests with respect to the basic physical and mechanical properties of a modified grouting material are conducted. In the tests, a water cement ratio is set to 0.5:1, flyash contents are set to 5%, 10%, 20%, and 30%, and curing times are set to 3 days, 7 days, and 28 days, and thus, 9 groups of different tests are designed with respect to viscosity, fluidity, bleeding ratio, stone rate, and cube crushing strength.

By analyzing the test results of these groups, according to a relationship between a flyash content and grouting performance, a mixing ratio of water, cement and flyash in the grouting material is 0.5:1:0.1.

A grouting filling test with pre-disintegrated soft rock filling mass is conducted. The compaction degree of the pre-disintegrated soft rock filling mass is considered as 90%, 93%, and 96% separately. A grouting pressure form is constant-pressure grouting, and the maximum pressure of the constant-pressure grouting is considered as 0.2 MPa, 0.4 MPa, 0.6 MPa, 0.8 MPa, and 1.0 MPa separately.

By coring the filling mass under different grouting parameters, filling mass samples with different distances to a grouting pipe are obtained, and the distances to the grouting pipe are 0.2 m, 0.4 m, 0.6 m, 0.8 m, and 1 m, respectively.

Dynamic triaxial tests are conducted on the obtained samples with different stress ratios and confining pressures to obtain dynamic rebound modulus and permanent axial deformations of the soil mass with different grouting parameters under the action of a dynamic stress.

The stress ratios are set to 1.2:1, 1.4:1, 1.6:1, 1.8:1, and 2.0:1, and the confining pressures are set to 10 kPa, 20 kPa, 30 kPa, 40 kPa, and 50 kPa.

By analyzing the test data, the influences of the grouting parameters and distances to the grouting pipe on the dynamic rebound modulus of the grouting filling mass are obtained, and a prediction model for a dynamic rebound modulus of grouting filling soil mass under the action of a dynamic stress is established, as shown in Equation (14):

$$E_1' = E_0' \cdot \left(0.65 + 0.11e^{\frac{P}{0.57}}\right) \cdot \left(3.11K^{27.32}\right) \cdot \left(0.69 + 7.73e^{-\frac{D}{0.18k}Pa}\right) \cdot \left(1.12 - 1.13e^{\frac{\sigma_{31}}{0.11Pa}} + 0.41\right) \cdot \left(2.37\frac{\sigma_{11}}{\sigma_{31}}^{-1.61}\right) \tag{14}$$

where $E'_0$ represents an initial dynamic rebound modulus of a common group of the grouting filling mass (with the grouting pressure of 0.6 MPa, the compaction degree of 96%, the distance of 0.6 m to the grouting pipe, the stress ratio of 1.6:1, and the confining pressure of 30 kPa), $E'_0$=283.74 MPa; $E'_1$ represents the dynamic rebound modulus of the grouted embankment soil mass; k=100, N/m (k is used for eliminating units and causing the units of the equation to be 1); P represents the grouting pressure; D represents a distance between the filling mass and a grouting hole; K represents the compaction degree of the embankment soil mass; $P_a$ represents the standard atmospheric pressure;

$$\frac{\sigma_{11}}{\sigma_{31}}$$

represents the stress ratio; $\sigma_{31}$ represents the confining pressure; and $\sigma_{11}$ represents the axial pressure.

According to the influences of the grouting parameters and the distance to the grouting pipe in the dynamic triaxial creep test, multiple non-linear regression analysis is performed on the test data, and a prediction model for a permanent strain of grouting filling soil mass under the action of a dynamic stress is established, as shown in Equation (15):

$$\varepsilon_2' = \varepsilon_{02}' \cdot \left(0.17\frac{\sigma_{11}}{\sigma_{31}}^{2.68}\right) \cdot \left(1.08 - 0.33e^{\frac{\sigma_{31}}{0.35Pa}}\right) \cdot \left(0.34K^{-26.01}\right) \cdot \left(2.56 - 2.69e^{-\frac{D}{1.09k}Pa}\right) \cdot \left(76\frac{P}{Pa}^{-0.58}\right) \tag{15}$$

where $\varepsilon'_{02}$ represents an initial plastic strain of the common group of grouting filling mass (with the grouting pressure of 0.6 MPa, the compaction degree of 96%, the distance of 0.6 m to the grouting pipe, the stress ratio of 1.6:1, and the confining pressure of 60 kPa), $\varepsilon'_{02}=934.68\times10^{-6}$; and $\varepsilon'_2$ represents the permanent strain of the grouted subgrade.

A total rebound deformation value $S'_{1x}$ on a vertical section of the grouted subgrade workspace under the action of a dynamic stress is calculated by Equation (16):

$$S_{1x}' = \sum S_{1f}' = \sum_{f=1}^{n} \overline{\varepsilon_{1qf}'} h_f \tag{16}$$

where $S'_{1f}$ represents a deformation between two adjacent nodes in the vertical section under the action of the dynamic stress; $\overline{\varepsilon'_{1qj}}$ represents an average strain between two adjacent nodes in the vertical section under the action of the dynamic stress; $\varepsilon'_{1qj}=\sigma_{qj}/E'_{1qj}$, the representation of $E'_{1qj}$ is identical to that of $E_{1qj}$, and the detail is shown in step S4.

A total settlement value $S'_{2x}$ on a vertical section of the grouted subgrade workspace under the action of a dynamic stress is calculated by Equation (17):

$$S'_{2x} = \sum S'_{2f} = \sum_{f=1}^{n} \overline{\varepsilon'_{2qj}} h_f \tag{17}$$

where $S'_{2f}$ represents a dynamic creep deformation between two adjacent nodes in the vertical section under the action of the dynamic stress; and $\overline{\varepsilon'_{2qj}}$ represents an average strain between two adjacent nodes in the vertical section under the action of the dynamic stress.

The calculation of settlement outside the grouted subgrade workspace is identical to the calculation of settlement outside the un-grouted subgrade workspace, and the specific step is shown in S4. A total settlement deformation value $S'_x$ of any vertical section in the longitudinal length direction of the grouted subgrade is calculated by Equation (18):

$$S'_x = S'_{1x} + S'_{2x} + S_{3x} \tag{18}$$

Equation (14) to Equation (18) are used in the grouted soil mass, and Equations (1), (2), (5), (6), and (9) are used in the un-grouted soil mass. Equation (9) is used for calculating the total settlement deformation value of any vertical section in the longitudinal length direction of the subgrade. If the total settlement value is greater than 20 mm, which does not meet requirements of the specification, the subgrade settlement needs to be reduced by the grouting treatment means so as to meet requirements of the specification. The total settlement after grouting is calculated by Equation (19).

By comparing the total settlement value of the un-grouted subgrade (calculated by Equation (9)) and the total settlement value of the grouted subgrade (calculated by Equation (18)), the effect of the grouting treatment means on subgrade settlement reduction may be demonstrated intuitively.

Test Example 1

For the settlement control zone, the stress state of each point of the subgrade is obtained by numerical simulation in step S4. Taking a vertical section in an embankment model as an example (q=5), the vertical stress $\sigma_{1i}$ and the lateral stress $\sigma_{3i}$ of the vertical section are exported and substituted into the prediction model for a dynamic rebound modulus. A total rebound deformation value $S_{1x}$ on a vertical section in the subgrade workspace under the action of a dynamic stress is obtained by Equation (5). Calculation results are as shown in the following Table 1, and specific steps are as shown in S3 and S4.

TABLE 1

Calculation Related Data of Subgrade $S_{1x}$ (K = 96%)

| Node No. | h/m | $\sigma_{11}$/ kPa | $\sigma_{31}$/ kPa | $\sigma_d$/ kPa | $E_1$/ kPa | $\varepsilon_{1qj}$ | $\overline{\varepsilon_{1qj}}$ | $S_{1f}$ m | $S_{1x}$ m |
|---|---|---|---|---|---|---|---|---|---|
| J(5, 0) | 0.00 | 2.47 | 6.87 | 27.06 | 1.03E+06 | 2.87E−05 | 5.97E−05 | 1.49E−05 | 3.42E−03 |
| J(5, 1) | 0.25 | 4.91 | 6.72 | 22.04 | 2.97E+05 | 9.07E−05 | 2.09E−04 | 5.22E−05 | |
| J(5, 2) | 0.50 | 9.73 | 6.53 | 18.06 | 8.50E+04 | 3.27E−04 | 5.00E−04 | 1.25E−04 | |
| J(5, 3) | 0.75 | 14.47 | 6.57 | 14.89 | 4.37E+04 | 6.72E−04 | 8.72E−04 | 2.18E−04 | |
| J(5, 4) | 1.00 | 19.16 | 6.80 | 12.37 | 2.94E+04 | 1.07E−03 | 1.27E−03 | 3.17E−04 | |
| J(5, 5) | 1.25 | 23.83 | 7.17 | 10.36 | 2.33E+04 | 1.47E−03 | 1.65E−03 | 4.12E−04 | |
| J(5, 6) | 1.50 | 28.50 | 7.67 | 8.77 | 2.04E+04 | 1.83E−03 | 1.98E−03 | 4.95E−04 | |
| J(5, 7) | 1.75 | 33.16 | 8.28 | 7.50 | 1.91E+04 | 2.13E−03 | 2.23E−03 | 5.58E−04 | |
| J(5, 8) | 2.00 | 37.84 | 9.02 | 6.50 | 1.89E+04 | 2.34E−03 | 2.40E−03 | 6.01E−04 | |
| J(5, 9) | 2.25 | 42.51 | 9.89 | 5.70 | 1.95E+04 | 2.47E−03 | 2.50E−03 | 6.24E−04 | |
| J(5, 10) | 2.50 | 47.18 | 10.89 | 5.06 | 2.07E+04 | 2.52E−03 | | | |

In the above table, "1.03E+06" is scientific notation, representing $1.03\times10^6$, which is an example for explaining the value in the table and unrelated to the calculation result data in the table.

The vertical stress $\sigma_{1i}$ and the lateral stress $\sigma_{3i}$ are substituted into the prediction model for a permanent strain of a subgrade under the action of a dynamic stress. A total settlement value $S_{2x}$ on a vertical section of the subgrade workspace under the action of a dynamic stress is obtained by Equation (6). Calculation results are as shown in Table 2, and specific steps are as shown in S3 and S4.

TABLE 2

| Calculation Related Data of Subgrade $S_{2x}$ (K = 96%) | | | | | | | |
|---|---|---|---|---|---|---|---|
| Node No. | h/m | $\sigma_{11}$/ kPa | $\sigma_{31}$/ kPa | $\varepsilon_{2qj}$ | $\overline{\varepsilon_{2qj}}$ | $S_{2j}$/ m | $S_{2x}$/ m |
| J(5, 0) | 0.00 | 2.47 | 6.87 | 2.53E−05 | 1.01E−04 | 2.54E−05 | 2.94E−02 |
| J(5, 1) | 0.25 | 4.91 | 6.72 | 1.78E−04 | 7.19E−04 | 1.80E−04 | |
| J(5, 2) | 0.50 | 9.73 | 6.53 | 1.26E−03 | 2.47E−03 | 6.19E−04 | |
| J(5, 3) | 0.75 | 14.47 | 6.57 | 3.69E−03 | 5.49E−03 | 1.37E−03 | |
| J(5, 4) | 1.00 | 19.16 | 6.80 | 7.29E−03 | 9.39E−03 | 2.35E−03 | |
| J(5, 5) | 1.25 | 23.83 | 7.17 | 1.15E−02 | 1.36E−02 | 3.40E−03 | |
| J(5, 6) | 1.50 | 28.50 | 7.67 | 1.57E−02 | 1.76E−02 | 4.39E−03 | |
| J(5, 7) | 1.75 | 33.16 | 8.28 | 1.94E−02 | 2.08E−02 | 5.20E−03 | |
| J(5, 8) | 2.00 | 37.84 | 9.02 | 2.22E−02 | 2.31E−02 | 5.77E−03 | |
| J(5, 9) | 2.25 | 42.51 | 9.89 | 2.39E−02 | 2.43E−02 | 6.08E−03 | |
| J(5, 10) | 2.50 | 47.18 | 10.89 | 2.47E−02 | | | |

The vertical stress $\sigma_{1i}$ and the lateral stress $\sigma_{3i}$ are substituted into the prediction model for a permanent strain of a subgrade under the action of a static stress. A total settlement value $S_{3x}$ on a vertical section of the subgrade non-workspace under the action of a self-weight stress is obtained by Equation (8). Calculation results are as shown in the following Table 3, and specific steps are shown in S5.

TABLE 3

| Calculation Related Data of Subgrade $S_{3x}$ (K = 96%) | | | | | | | |
|---|---|---|---|---|---|---|---|
| Node No. | h/m | $\sigma_{11}$/ kPa | $\sigma_{31}$/ kPa | $\varepsilon_{3qj}$ | $\overline{\varepsilon_{3qj}}$ | $S_{3j}$/ m | $S_{3x}$/ m |
| J(5, 10) | 2.50 | 47.18 | 10.89 | 2.31E−03 | 2.31E−03 | 5.78E−04 | 4.71E−03 |
| J(5, 11) | 2.75 | 51.85 | 12.03 | 2.31E−03 | 2.28E−03 | 5.71E−04 | |
| J(5, 12) | 3.00 | 56.51 | 13.32 | 2.25E−03 | 2.20E−03 | 5.51E−04 | |
| J(5, 13) | 3.25 | 61.17 | 14.77 | 2.16E−03 | 2.10E−03 | 5.24E−04 | |
| J(5, 14) | 3.50 | 65.81 | 16.38 | 2.04E−03 | 1.97E−03 | 4.93E−04 | |
| J(5, 15) | 3.75 | 70.44 | 18.16 | 1.91E−03 | 1.84E−03 | 4.60E−04 | |
| J(5, 16) | 4.00 | 75.04 | 20.12 | 1.77E−03 | 1.71E−03 | 4.27E−04 | |
| J(5, 17) | 4.25 | 79.62 | 22.26 | 1.64E−03 | 1.58E−03 | 3.96E−04 | |
| J(5, 18) | 4.50 | 84.18 | 24.60 | 1.52E−03 | 1.47E−03 | 3.67E−04 | |
| J(5, 19) | 4.75 | 88.70 | 27.13 | 1.41E−03 | 1.39E−03 | 3.47E−04 | |
| J(5, 20) | 5.00 | 90.95 | 28.45 | 1.37E−03 | | | |

Figure 10:
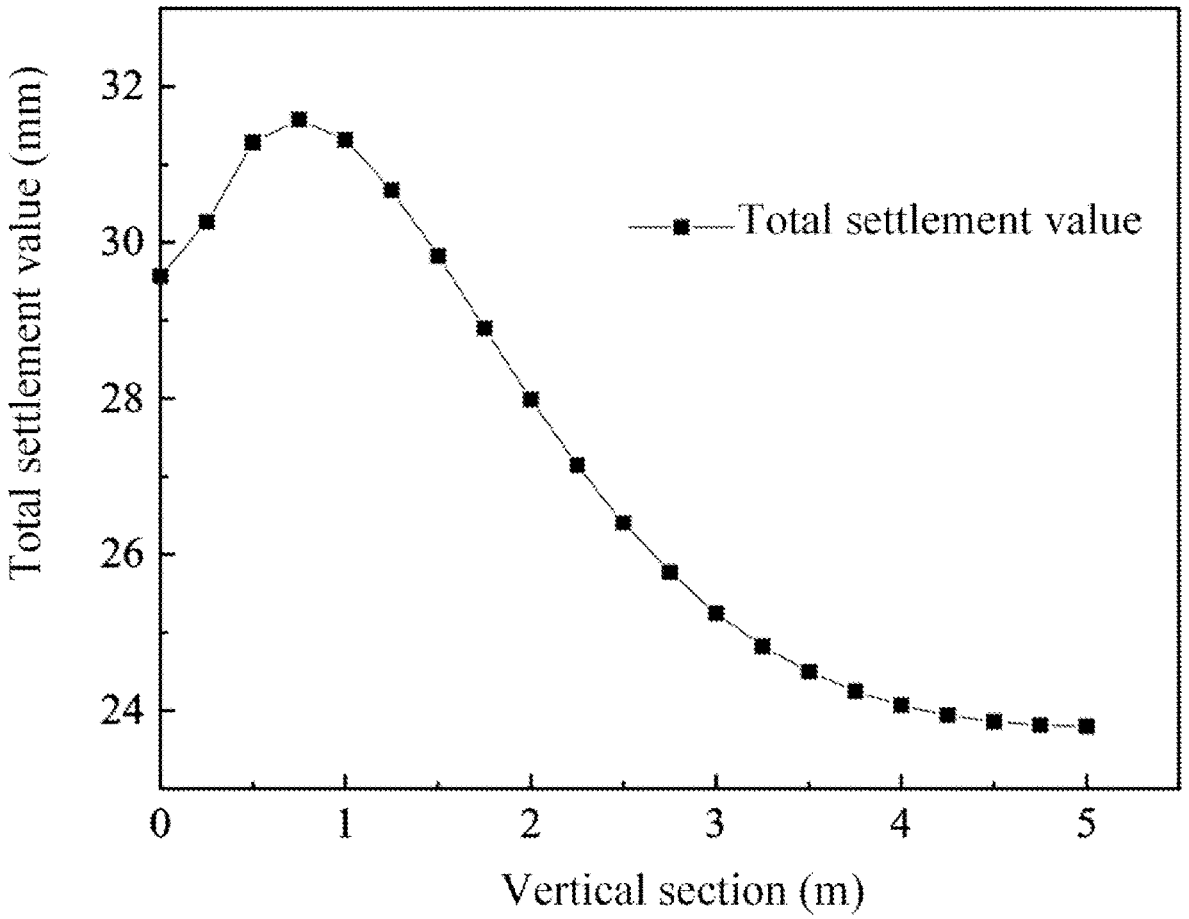
FIG. 10 is a schematic diagram illustrating total settlement values of vertical sections of an original subgrade according to an embodiment of the present disclosure.

According to the above data, the total subgrade settlement $S_x$ of the vertical section is calculated by Equation (9) to be 30.68 mm, which is greater than 20 mm and does not meet the specified total settlement indicator. The calculation of settlement of any vertical section of the subgrade is consistent with the calculation method of settlement of this vertical section, and the total settlement of each vertical section of the subgrade is obtained by calculation, as shown in FIG. 10.

Figure 11:
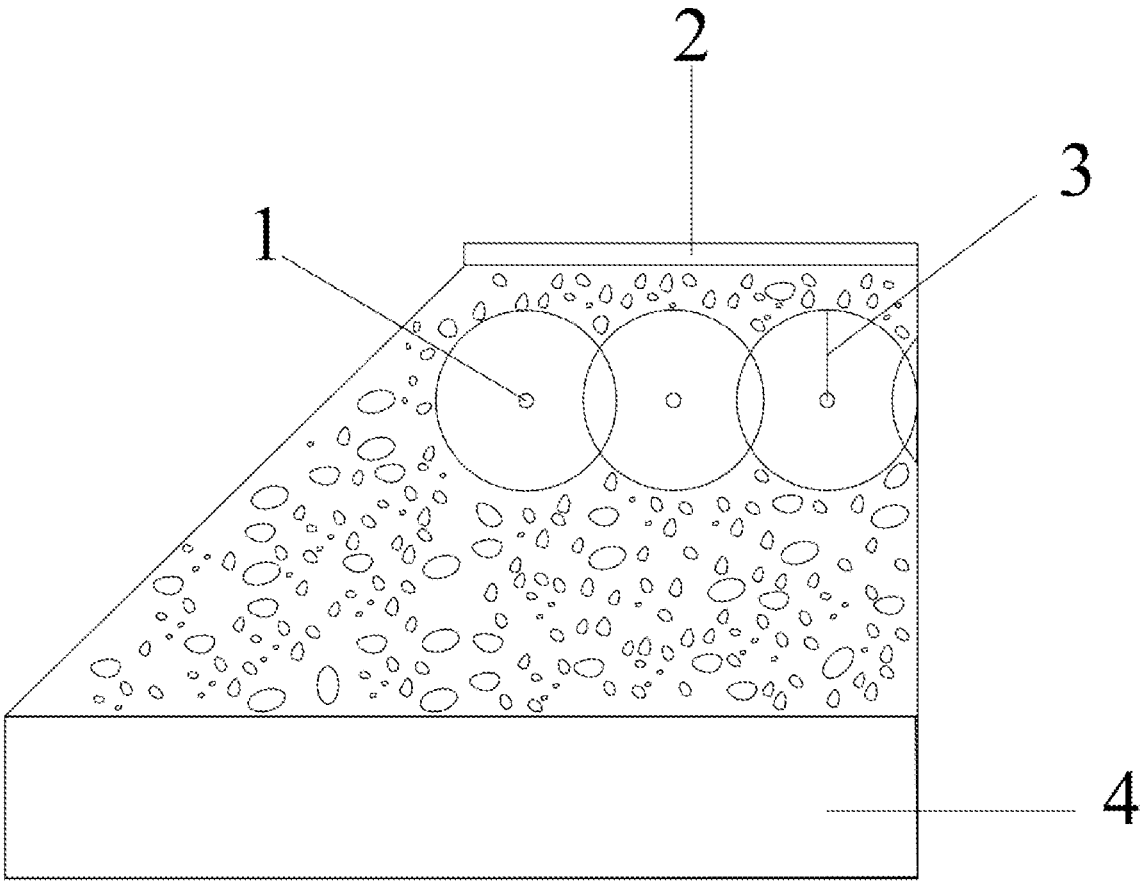
FIG. 11 is an arrangement diagram of grouting pipes according to an embodiment of the present disclosure.

The grouting pressure is set as P=0.6 MPa and the compaction degree is set as K=96%. As subgrade settlement mostly occurs in the subgrade workspace, the grouting treatment is performed only on the subgrade workspace. As shown in FIG. 11, grouting pipes 1 are buried in the subgrade above foundation 4, and pavement 2 is arranged at the top of the foundation. The positions of the grouting pipes 1 are respectively as follows: X=0.5 m, Y=3.5 m; X=2.25 m, Y=3.5 m; X=4.0 m, Y=3.5 m (taking the embankment model in S4 as an example), and grouting radius 3 is 1 m. Taking the vertical section in the embankment model as an example (q=5), calculation results are as shown in the following Table 4 and Table 5, and specific steps are shown in S12.

TABLE 4

| Calculation Related Data of Grouted Subgrade Workspace $S'_{1x}$ (K = 96%) | | | | | | | | | |
|---|---|---|---|---|---|---|---|---|---|
| Node No. | h/m | $\sigma_{11}$/ kPa | $\sigma_{31}$/ kPa | $\sigma_d$/ kPa | $E'_1$/ kPa | $\varepsilon'_{1qj}$ | $\overline{\varepsilon'_{1qj}}$ | $S'_{1j}$/ m | $S'_{1x}$/ m |
| J(5, 0) | 0.00 | 2.47 | 6.87 | 27.06 | 1.03E+06 | 2.87E−05 | 5.97E−05 | 1.49E−05 | 2.52E−03 |
| J(5, 1) | 0.25 | 4.91 | 6.72 | 22.04 | 2.97E+05 | 9.07E−05 | 2.09E−04 | 5.22E−05 | |
| J(5, 2) | 0.50 | 9.73 | 6.53 | 18.06 | 8.50E+04 | 3.27E−04 | 5.00E−04 | 1.25E−04 | |
| J(5, 3) | 0.75 | 14.47 | 6.57 | 14.89 | 4.37E+04 | 6.72E−04 | 6.70E−04 | 1.67E−04 | |
| J(5, 4) | 1.00 | 19.16 | 6.80 | 12.37 | 4.72E+04 | 6.68E−04 | 7.62E−04 | 1.90E−04 | |
| J(5, 5) | 1.25 | 23.83 | 7.17 | 10.36 | 3.99E+04 | 8.56E−04 | 9.45E−04 | 2.36E−04 | |
| J(5, 6) | 1.50 | 28.50 | 7.67 | 8.77 | 3.61E+04 | 1.03E−03 | 1.14E−03 | 2.84E−04 | |
| J(5, 7) | 1.75 | 33.16 | 8.28 | 7.50 | 3.28E+04 | 1.24E−03 | 1.35E−03 | 3.38E−04 | |
| J(5, 8) | 2.00 | 37.84 | 9.02 | 6.50 | 3.04E+04 | 1.46E−03 | 1.96E−03 | 4.91E−04 | |

TABLE 4-continued

| Calculation Related Data of Grouted Subgrade Workspace $S'_{1x}$ (K = 96%) | | | | | | | | | |
|---|---|---|---|---|---|---|---|---|---|
| Node No. | h/m | $\sigma_{11}$/ kPa | $\sigma_{31}$/ kPa | $\sigma_d$/ kPa | $E'_1$/ kPa | $\varepsilon'_{1qj}$ | $\overline{\varepsilon'_{1qj}}$ | $S'_{1f}$/ m | $S'_{1x}$/ m |
| J(5, 9) | 2.25 | 42.51 | 9.89 | 5.70 | 1.95E+04 | 2.47E−03 | 2.50E−03 | 6.24E−04 | |
| J(5, 10) | 2.50 | 47.18 | 10.89 | 5.06 | 2.07E+04 | 2.52E−03 | | | |

TABLE 5

| Calculation Related Data of Grouted Subgrade Workspace $S'_{2x}$ (K = 96%) | | | | | | | |
|---|---|---|---|---|---|---|---|
| Node No. | h/m | $\sigma_{11}$/ kPa | $\sigma_{31}$/ kPa | $\varepsilon'_{2qj}$ | $\overline{\varepsilon'_{2qj}}$ | $S'_{2f}$ m | $S'_{2x}$ m |
| J(5, 0) | 0.00 | 2.47 | 6.87 | 2.53E−05 | 1.01E−04 | 2.54E−05 | 1.72E−02 |
| J(5, 1) | 0.25 | 4.91 | 6.72 | 1.78E−04 | 7.19E−04 | 1.80E−04 | |
| J(5, 2) | 0.50 | 9.73 | 6.53 | 1.26E−03 | 2.47E−03 | 6.19E−04 | |
| J(5, 3) | 0.75 | 14.47 | 6.57 | 3.69E−03 | 3.28E−03 | 8.20E−04 | |
| J(5, 4) | 1.00 | 19.16 | 6.80 | 2.87E−03 | 3.47E−03 | 8.68E−04 | |
| J(5, 5) | 1.25 | 23.83 | 7.17 | 4.07E−03 | 4.69E−03 | 1.17E−03 | |
| J(5, 6) | 1.50 | 28.50 | 7.67 | 5.30E−03 | 6.04E−03 | 1.51E−03 | |
| J(5, 7) | 1.75 | 33.16 | 8.28 | 6.77E−03 | 7.63E−03 | 1.91E−03 | |
| J(5, 8) | 2.00 | 37.84 | 9.02 | 8.49E−03 | 1.62E−02 | 4.06E−03 | |
| J(5, 9) | 2.25 | 42.51 | 9.89 | 2.39E−02 | 2.43E−02 | 6.08E−03 | |
| J(5, 10) | 2.50 | 47.18 | 10.89 | 2.47E−02 | | | |

Figure 12:
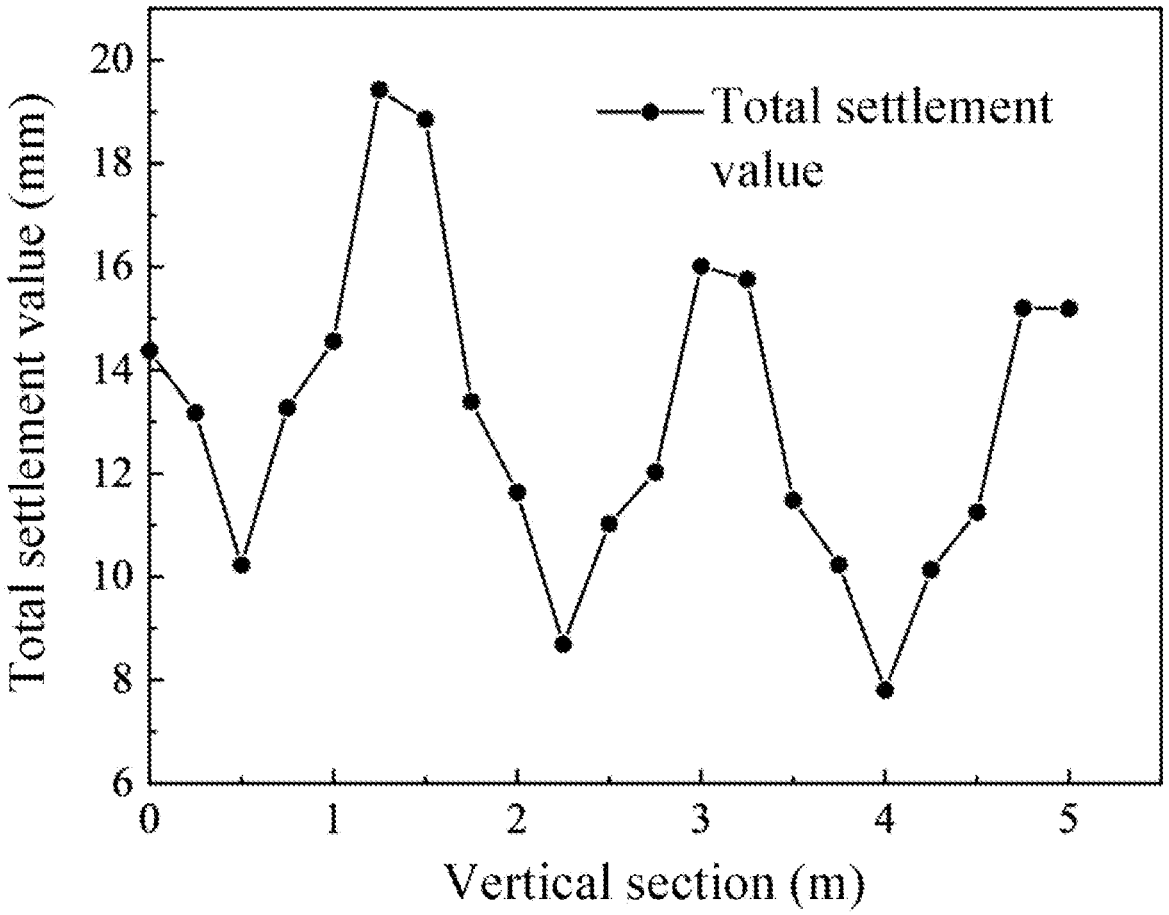
FIG. 12 is a schematic diagram illustrating total settlement values of vertical sections of a grouted subgrade according to an embodiment of the present disclosure.

According to the above data, the total settlement deformation $S'_x$ of the grouted subgrade of the vertical section is calculated by Equation (18) to be 19.43 mm, which is less than 20 mm and meets the specified total settlement indicator. The calculation of settlement of any vertical section of the grouted subgrade is consistent with the calculation method of settlement of this vertical section, and the total settlement of each vertical section of the grouted subgrade is shown in FIG. 12. The total settlement of each vertical section meets the specified total settlement indicator.

The subgrade condition is evaluated from the perspective of the tensile strength of a material. By integrating settlement calculation data, a top surface node has the maximum strain value $\varepsilon'_{2qjmax}$=3.61E-04. The highway grade is heavy duty with the tensile strength of 2.0 MPa. The strength grade of lean concrete is C30 with elastic modulus $E=3.35\times10^4$ MPa, and strain value $\varepsilon_d$ of concrete pavements at tensile limit is calculated to be 5.97E-03 (standardized pursuant to "Technical Rules for Construction of Highway Cement Concrete Pavements" (JTG/T F30-2014), and the strain standard value is obtained by Equation $\varepsilon=\sigma/E$). Because of $\varepsilon_{2qjmax}$=3.61E-04<$\varepsilon_d$=5.97E-03, a specified strain design value is satisfied, indicating that the cement stabilized base course of the pavement does not crack and is in good condition.

In this test example, the settlement situations of the embankment settlement control zone before and after grouting under same working conditions are compared. The subgrade settlement before grouting does not meet requirements of the specification, and after the grouting treatment, the subgrade settlement meets requirements of the specification. The calculation process is expressed in the form of a table, which intuitively reflects the grouting effect and proves that the treatment means for the embankment settlement control zone is feasible.

Test Example 2

For the shear-settlement control zone, which is taken into account as the shear control zone, on the premise of satisfying the designed safe value of the shear failure ratio, the settlement deformations of the soil mass before and after modification are compared. The pre-disintegrated soft rock obtained in step S1 is mixed with different proportions of cement, and specific proportions are 0%, 1%, 2%, 4%, and 8%, and samples are prepared by the stratified sample compression method. Static triaxial creep tests are conducted on the obtained samples with different stress ratios, compaction degrees, and confining pressures to obtain permanent axial deformations of the modified embankment soil mass under the action of a static stress.

The stress ratios are set to 1.2:1, 1.4:1, 1.6:1, 1.8:1, and 2.0:1; the compaction degrees are set to 90%, 93%, and 96%; and the confining pressures are set to 10 kPa, 20 kPa, 30 kPa, 40 kPa, and 50 kPa.

According to a change rule of the permanent axial deformation of the modified soil mass under conditions of different stress ratios, compaction degrees, confining pressures, and mixing amounts in the static triaxial creep tests, multiple non-linear regression analysis is performed on the test data, and a prediction model for a permanent strain of a modified subgrade under the action of a self-weight stress is established, as shown in Equation (19):

$$\varepsilon'_3 = \varepsilon'_0 \cdot \left(0.16\frac{\sigma_{11}}{\sigma_{31}}^{2.52}\right) \cdot \left(0.26e^{\frac{\sigma_{31}}{0.35P_a}} + 0.39\right) \cdot \left(0.41K^{-33.95}\right) \cdot \left(0.65e^{-x/16.13} + 0.36\right) \tag{19}$$

where $\varepsilon'_0$ represents an initial plastic strain of the common group of the modified samples (with the stress ratio of 1.6:1, the confining pressure of 30 kPa, the compaction degree of 96%, and the mixing amount of 1%), $\varepsilon'_0=155.42\times10^{-6}$; and $\varepsilon'_3$ represents the permanent strain of the modified subgrade under the action of the self-weight stress.

A total settlement $S'_{3x}$ on a vertical section of the modified subgrade under the action of a self-weight stress is calculated by Equation (20):

$$S'_{3x} = \sum S'_{3f} = \sum_{f=1}^{n} \overline{\varepsilon'_{3qj}} h_f \quad (20)$$

where $S'_{3f}$ represents a static creep deformation between two adjacent nodes in the vertical section under the action of the self-weight stress; and $\overline{\varepsilon'_{3qj}}$ represents an average strain between two adjacent nodes in the vertical section under the action of the self-weight stress.

In a same stress state, $\varepsilon'_3 < \varepsilon_3$, the settlement calculated by Equation (20) will be less than that calculated by Equation (8), indicating that the settlement of the cement modified subgrade will be less than that the unmodified subgrade on the same vertical section. Therefore, the shear-settlement control zone may be regarded as the settlement control zone provided that the shear failure ratio of the shear-settlement control zone is less than 0.8.

The test example shows that the settlement of the modified subgrade also meets the requirement. The settlement of the cement modified embankment shear-settlement control zone will be less than that before modification, indicating that the influence of adding cement on settlement is positive. By regarding the shear-settlement control zone as the settlement control zone, not only is the settlement specification requirement met (provided that the shear failure ratio is satisfied, and therefore, the requirement of the shear control zone is also met), but also the settlement is less with higher safety. Since different zones have different shear failure ratio peaks, the modified soil with different mixing amounts of cement is used to fill different shear zones. Compared with a traditional modifying filling way, the amount of a traditional cementing material used may be greatly reduced in the embodiments of the present disclosure, and the construction cost of a project in terms of materials may be reduced.

In the embodiments of the present disclosure, according to the shear failure ratio and settlement deformation of the pre-disintegrated soft rock embankment, the embankment includes the shear control zone, the settlement control zone, and the shear-settlement control zone, and the parameter design values of different zones are obtained by inversion based on the spatial function zones (the parameter of the shear control zone is a mixing amount of cement, the parameters of the settlement control zone are a filling mass compaction degree, a grouting pressure, and a distance to a grouting pipe, and the parameters of the shear-settlement control zone are all the above-mentioned parameters). According to the deformation parameter design value of the settlement control zone of the pre-disintegrated soft rock embankment, the optimal grouting parameters are preferred to solve the material problems of the pre-disintegrated soft rock embankment based on spatial function zones. The prediction models for dynamic and static creep deformations and a dynamic rebound modulus of pre-disintegrated soft rock and for a shear failure ratio under the influence of different mixing amounts are established, and the problems of the design method of the pre-disintegrated soft rock embankment structure based on spatial function zones are solved.

In the embodiments of the present disclosure, the soil mass in different zones is treated by using different means. The treatment means are adjusted according to circumstances, thus not only improving the stability of the embankment but also reducing the engineering construction cost under the premise of meeting requirements of the specification. The soil mass of the cement modified shear control zone can effectively strengthen a side slope and prevent the instability failure of the side slope. The grouted filled settlement control zone can positively improve the internal compactness of the pre-disintegrated soft rock and reduce the settlement deformation of the subgrade. Moreover, when bad geological rock-soil mass is utilized to fill an embankment, compared with traditional treatment techniques such as a retaining wall, layered geogrids, and overall modification and strengthening, the embankment structure design proposed in the embodiments of the present disclosure allows different treatment means to be implemented for different zones and emphasizes acting according to circumstances. On the basis of realizing the overall safety and stability of the embankment, the construction cost is significantly reduced.

The foregoing are merely descriptions of the preferred embodiments of the present disclosure and not intended to limit the protection scope of the present disclosure. Any modifications, equivalent substitutions, and improvements made within the spirit and scope of the present disclosure should fall within the protection scope of the present disclosure.

What is claimed is:

1. A design method of the pre-disintegrated soft rock embankment structure based on spatial function zones, comprising:

S1, performing field sampling at a pre-disintegrated soft rock embankment and preparing a sample by a stratified sample compression method;

S2, conducting a static triaxial test on the sample in step S1 under test conditions of different confining pressures to obtain a cohesive force c and an internal friction angle 4 of pre-disintegrated soft rock-soil mass, and obtaining a strength envelope formula for pre-disintegrated soft rock by processing static triaxial test data;

S3, conducting a dynamic triaxial test on the sample in step S1 with different stress ratios, compaction degrees, and confining pressures to obtain a permanent axial deformation and a dynamic rebound modulus of embankment soil mass under action of a dynamic load, and establishing a prediction model for a dynamic rebound modulus of embankment soil mass and a prediction model for a permanent strain of a subgrade under the action of the dynamic stress;

S4, establishing a two-dimensional finite element numerical model of the pre-disintegrated soft rock embankment through finite element software, with consideration of the action of the dynamic stress and with an X-axis representing a longitudinal length of the subgrade and a Y-axis representing a height of the subgrade, meshing the two-dimensional finite element numerical model, and exporting coordinates of each node in the two-dimensional finite element numerical model and a vertical stress $\sigma_{1qj}$ a lateral stress $\sigma_{3qj}$ and a dynamic stress corresponding to each node;

S5, conducting a static triaxial creep test on the sample prepared in step S1 with different stress ratios and compaction degrees to obtain a permanent axial deformation of the embankment soil mass under action of a static stress, and establishing a prediction model for a permanent strain of a subgrade under the action of the static stress;

S6, establishing a two-dimensional finite element numerical model of the pre-disintegrated soft rock embankment by using the finite element software without consideration of the action of the dynamic stress, obtaining distribution rules of depths and shear failure ratios of a subgrade workspace, and dividing an embankment structure into an embankment shear control zone, an embankment settlement control zone, and an embankment shear-settlement control zone; wherein the embankment shear control zone is a zone in which a shear failure ratio is greater than a predetermined value; the embankment settlement control zone is a filled zone right below a top surface of an embankment; and the embankment shear-settlement control zone is an intersection of the embankment shear control zone and the embankment settlement control zone; and S7, based on divided spatial function zones, obtaining parameter design values of different zones by inversion, and carrying out a modified mixing ratio design for pre-disintegrated soft rock.

2. The design method of the pre-disintegrated soft rock embankment structure based on spatial function zones according to claim 1, wherein in step S2, the static triaxial test is an consolidated-undrained static triaxial test in which a compaction degree of the sample is 96%, the confining pressures are set to 10 kPa, 20 kPa, 30 kPa, 40 kPa, and 50 kPa, and a water content of the soil mass is a natural moisture content; and in step S3, the stress ratios in the dynamic triaxial test are set to 1.2:1, 1.4:1, 1.6:1, 1.8:1, and 2.0:1; the compaction degrees are set to 90%, 93%, and 96%; the confining pressures are set to 10 kPa, 20 kPa, 30 kPa, 40 kPa, and 50 kPa; the water content of the soil mass is the natural moisture content; and times of dynamic load application is 10000.

3. The design method of the pre-disintegrated soft rock embankment structure based on spatial function zones according to claim 1, wherein in step S3, the prediction model for the dynamic rebound modulus of the embankment soil mass is shown in Equation (1-1):

$$E_1 = E_0 \cdot \left(2.51 \frac{\sigma_{11}}{\sigma_{31}}^{-1.72}\right) \cdot \left(-1.16 e^{\frac{\sigma_{31}}{0.15 Pa}} + 1.11\right) \cdot \left(12.12 K^{61.15}\right) \quad (1\text{-}1)$$

wherein $E_0$ represents an initial dynamic rebound modulus of a common group; $E_1$ represents the dynamic rebound modulus of the embankment soil mass; e represents a constant;

$$\frac{\sigma_{11}}{\sigma_{31}}$$

represents a stress ratio; $\sigma_{31}$ represents a confining pressure; $P_a$ represents a standard atmospheric pressure, $P_a$=101.4 kPa; K represents a compaction degree of the embankment soil mass; and $\sigma_{11}$ represents an axial pressure; and the prediction model for the permanent strain of the subgrade under the action of the dynamic stress is shown in Equation (1-2):

$$\varepsilon_2 = \varepsilon_{02} \cdot \left(0.17 \frac{\sigma_{11}}{\sigma_{31}}^{2.75}\right) \cdot \left(1.15 - 0.38 e^{-\frac{\sigma_{31}}{0.37 P_a}}\right) \cdot \left(0.42 K^{-34.4}\right) \quad (1\text{-}2)$$

wherein $\varepsilon_{02}$ represents an initial plastic strain of the common group; and $\varepsilon_2$ represents the permanent strain of the subgrade.

4. The design method of the pre-disintegrated soft rock embankment structure based on spatial function zones according to claim 1, wherein in step S4, a stress $\sigma_{qj}$ of each node under combined action of the dynamic stress and a self-weight stress is calculated by Equation (1-4):

$$\sigma_{qj} = \sigma_{1qj} + \sigma'_{qj} \quad (1\text{-}4)$$

a strain value $\varepsilon_{1qj}$ of each node under the combined action of the dynamic stress and the self-weight stress is calculated by Equation (1-5):

$$\varepsilon_{1qj} = \sigma_{qj}/E_{1qj} \quad (1\text{-}5)$$

wherein the dynamic rebound modulus $E_{1qj}$ is calculated by substituting the vertical stress $\sigma_{1qj}$ and the lateral stress $\sigma_{3gj}$ of a node of the subgrade workspace into Equation (1-1), wherein $\sigma_{1qj}$ corresponds to $\sigma_{11}$ in Equation (1-1), and $\sigma_{3qj}$ corresponds to $\sigma_{31}$ in Equation (1-1);

a total rebound deformation value $S_{1x}$ on a vertical section of the subgrade workspace under the action of the dynamic stress is calculated by Equation (1-6):

$$S_{1x} = \sum S_{1f} = \sum_{f=1}^{n} \overline{\varepsilon_{1qj}} h_f \quad (1\text{-}6)$$

wherein $S_{1f}$ represents a deformation between two adjacent nodes in the vertical section under the action of the dynamic stress; $\overline{\varepsilon_{1qj}}$ represents an average strain of two adjacent nodes in the vertical section under the action of the dynamic stress; x in $S_{1x}$ represents a point in a longitudinal length X of the subgrade, namely a position of the vertical section on the X-axis; and $h_f$ represents a length between an upper node and a lower node in a fth node segment, f=1, 2, . . . , n; and a total settlement value $S_{2x}$ on a vertical section of the subgrade workspace under the action of the dynamic stress is calculated by Equation (1-7):

$$S_{2x} = \sum S_{2f} = \sum_{f=1}^{n} \overline{\varepsilon_{2qj}} h_f \quad (1\text{-}7)$$

wherein $S_{2f}$ represents a dynamic creep deformation between two adjacent nodes in the vertical section under the action of the dynamic stress; and $\overline{\varepsilon_{2gj}}$ represents an average strain between two adjacent nodes in the vertical section under the action of the dynamic stress.

5. The design method of the pre-disintegrated soft rock embankment structure based on spatial function zones according to claim 4, wherein in step S5, the prediction model for the permanent strain of the subgrade under the action of the static stress is shown in Equation (1-3):

$$\varepsilon_3 = \varepsilon_{03} \cdot \left(0.18 \frac{\sigma_{11}}{\sigma_{31}}^{2.54}\right) \cdot \left(0.13 e^{\frac{\sigma_{31}}{0.24 P_a}} + 0.59\right) \cdot \left(0.54 K^{-34.44}\right) \quad (1\text{-}3)$$

wherein $\varepsilon_{03}$ represents an initial plastic strain of the soil mass in the common group; and $\varepsilon_3$ represents a permanent strain of the subgrade under the action of the self-weight stress;

a total settlement value $S_{3x}$ on a vertical section of a subgrade non-workspace under the action of the self-weight stress is calculated by Equation (1-8):

$$S_{3x} = \sum S_{3f} = \sum_{f=1}^{n} \overline{\varepsilon_{3qj}} h_f \tag{1-8}$$

wherein $S_{3f}$ represents a static creep deformation between two adjacent nodes in the vertical section under the action of the self-weight stress; and $\overline{\varepsilon_{3qj}}$ represents an average strain between two adjacent nodes in the vertical section under the action of the self-weight stress; and based on superimposed settlement of unit nodes, a total settlement deformation $S_x$ of any vertical section in a longitudinal length direction of the subgrade is calculated by Equation (1-9):

$$S_x = S_{1x} + S_{2x} + S_{3x}. \tag{1-9}$$

6. The design method of the pre-disintegrated soft rock embankment structure based on spatial function zones according to claim 1, wherein in step S6, the shear failure ratio F is calculated by following equation:

$$F = \frac{r}{R}$$

wherein r represents a radius of a Mohr's stress circle of the embankment soil mass plotted in a current stress state, and R represents a vertical distance of a center of the Mohr's stress circle to a shear strength envelope.

7. The design method of the pre-disintegrated soft rock embankment structure based on spatial function zones according to claim 1, wherein in step S7, inversion parameters of the embankment shear-settlement control zone are a shear failure ratio and a subgrade settlement deformation value, and the shear failure ratio is caused to be less than a designed safe value by increasing a cohesive force or an internal friction angle thereof; and subgrade settlement is determined by a compaction degree of filling mass, a grouting pressure, and a distance to a grouting pipe, and is caused to be less than a subgrade deformation design value.

8. The design method of the pre-disintegrated soft rock embankment structure based on spatial function zones according to claim 7, wherein respective fitted curve functions of a cohesive force and an internal friction angle of modified soil mass with a mixing amount are as follows:

$$c' = -35.01e^{-x/4.3} + 48.52 \tag{1-10}$$

$$\phi' = 22.63x^{0.19} \tag{1-11}$$

wherein c' represents the cohesive force after modification; φ' represents the internal friction angle after modification; and x represents the mixing amount, $x \in [1\%, 8\%]$;

a prediction model for a shear failure ratio under influence of different mixing amounts is established according to relationships of a cohesive force and an internal friction angle with a shear failure ratio F in a modification test, as shown in Equation (1-12):

$$F = \frac{r}{R} = \frac{(\sigma_{max} - \sigma_{min})\left(\sqrt{\tan^2 f(x) + 1}\right)}{2(\tan f(x) \cdot L + g(x))} \tag{1-12}$$

wherein r represents the radius of a Mohr's stress circle of the embankment soil mass plotted in current stress state, and R represents a vertical distance of a center of the Mohr's stress circle to the shear strength envelope, $$r = \frac{\sigma_{max} - \sigma_{min}}{2},\ R = \frac{\tan\varphi \cdot L + c}{\sqrt{\tan^2\varphi + 1}},\ L = \frac{\sigma_{max} + \sigma_{min}}{2},$$

$\sigma_{max}$ representing a maximum principal stress on the soil mass at a current position and $\sigma_{min}$ representing a minimum principal stress on the soil mass at the current position.

9. The design method of the pre-disintegrated soft rock embankment structure based on spatial function zones according to claim 1, wherein the predetermined value of the shear failure ratio is determined to be 10%-20% less than a critical value.

* * * * *